US007186126B2

(12) United States Patent
Umehara et al.

(10) Patent No.: US 7,186,126 B2
(45) Date of Patent: Mar. 6, 2007

(54) FLOATING ELECTRICAL CONNECTOR

(75) Inventors: Masata Umehara, Tokyo (JP); Akira Kubo, Tokyo (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/383,091

(22) Filed: May 12, 2006

(65) Prior Publication Data

US 2006/0258199 A1 Nov. 16, 2006

(30) Foreign Application Priority Data

May 12, 2005 (JP) ..... 2005-140159

(51) Int. Cl.
*H01R 13/64* (2006.01)

(52) U.S. Cl. ..... 439/247

(58) Field of Classification Search ..... 439/247–248, 439/266

See application file for complete search history.

(56) References Cited

U.S. PATENT DOCUMENTS 4,580,862 A * 4/1986 Johnson ..... 439/248
4,588,244 A * 5/1986 Anhalt et al. ..... 439/368
4,780,090 A * 10/1988 Sugiyama et al. ..... 439/247
4,872,850 A * 10/1989 Mogi et al. ..... 439/264
5,306,169 A * 4/1994 Fukushima et al. ..... 439/248
5,752,845 A * 5/1998 Fu ..... 439/247
6,062,872 A * 5/2000 Strange et al. ..... 439/67
6,422,886 B1 * 7/2002 Macbeth et al. ..... 439/247
6,527,572 B2 * 3/2003 Jou ..... 439/248
6,890,200 B1 * 5/2005 Wu ..... 439/247
6,939,154 B2 * 9/2005 Horikoshi et al. ..... 439/247
7,056,135 B2 * 6/2006 Chen ..... 439/247
7,090,521 B2 * 8/2006 Nishio et al. ..... 439/248
7,104,810 B2 * 9/2006 Kawakita et al. ..... 439/76.2
2006/0035500 A1 * 2/2006 Sugita et al. ..... 439/247
2006/0105603 A1 * 5/2006 Nishio et al. ..... 439/247
2006/0183363 A1 * 8/2006 Chen ..... 439/247

FOREIGN PATENT DOCUMENTS

JP 2004-119050 4/2004

* cited by examiner

*Primary Examiner*—Tho D. Ta
*Assistant Examiner*—Larisa Tsukerman
(74) *Attorney, Agent, or Firm*—Barley Snyder LLC

(57) ABSTRACT

A floating connector is disclosed which can avoid a danger that the pin bodies will contact the inner circumferential surfaces of the through-holes formed in the movable housing when the movable housing moves in the vertical direction with respect to the fixed housing. In the floating connector, the fixed housing comprises a housing main body that fastens the terminal sections of the contacts in place and tubular bosses that protrude from the housing main body. The second through-holes through which the pin bodies are inserted into are formed so as to pass through both the housing main body and bosses, and the inner diameter of the first through-holes in the movable housing through which the pin bodies 40 are inserted allows the bosses to be inserted and also allows the movable housing to move upward and downward with respect to the fixed housing, so that the bosses are inserted into the first through-holes.

9 Claims, 9 Drawing Sheets

Prior Art

Prior Art

FLOATING ELECTRICAL CONNECTOR

FIELD OF THE INVENTION

The invention relates to a floating electrical connector and more particularly a floating electrical connector for connecting two circuit boards to each other.

BACKGROUND

The connector shown in FIGS. 9A, 9B, and 10A to 10C (see JP2004-119050A), for example, is known as a floating connector used to electrically connect two circuit boards to each other. In FIGS. 9A and 9B, and 10A to 10C, the floating connector 101 comprises a plurality of contacts 110 made of metal, a movable housing 120, a fixed housing 130, and a pair of pin bodies 140.

Furthermore, each of the contacts 110 comprises a mating section 111 that contacts one of the mating contacts provided on a mating connector (not shown in the figures), a terminal section 112 that is connected to a circuit board (not shown in the figures), and a flexible link 113 that has flexibility and that links the mating section 111 and terminal section 112. The mating connector is mounted on another circuit board that is disposed perpendicular to the circuit board to which the terminal sections 112 are connected.

Moreover, the movable housing 120 has a substantially rectangular shape that extends in the direction of length (left-right direction in FIG. 9A), and is provided with a plurality of contact receiving openings 121 that accommodate the mating sections 111 of the contacts 110 at a specified pitch along the direction of length.

In addition, the fixed housing 130 has a substantially rectangular shape that extends in the direction of length, and is designed to fasten the terminal sections 112 of the contacts 110 in place.

The movable housing 120 is disposed on top of the fixed housing 130 at a distance Y from the fixed housing 130. Furthermore, a pair of first through-holes 122 are bored in either end of the movable housing 120 and a pair of second through-holes 131 are bored in either end of the fixed housing 130 in positions corresponding to the first through-holes 122. The movable housing 120 is linked with the fixed housing 130 via the flexible links 113 of the contacts 111.

Each pin body 140 is in the form of a metal rod having a substantially cylindrical shape. Each pin body 140 has a flange 142 that protrudes in a position near the lower end portion, and has a length which is such that with this flange 142 as a border, the tip 141 is long, and the rear end 143 is short. In addition, the tips 141 of the respective pin bodies 140 pass through the second through-holes 131 from the bottom of the fixed housing 130, and are inserted through the first through-holes 122 in the movable housing 120. The diameter of the tip 141 of each pin body 140 is slightly smaller than the diameter of each first through-hole 122, so that the tips 141 are formed with a diameter which is such that at least the movable housing 120 can move smoothly upward and downward in a state in which the tips 141 are inserted through these first through-holes 122. Furthermore, the inner diameter of the second through-holes 131 is substantially closed to the outer diameter of the tips 141, so that the outer circumferential surfaces of the tips 141 respectively contact the inner circumferential surfaces of the second through-holes 131 in a state in which the tips 141 are inserted into the second through-holes 131. Moreover, the rear ends 143 of the pin bodies 140 are designed to be inserted into positioning holes (not shown in the figures) formed in the circuit board and to be connected by soldering to the circuit board.

When a mating connector mates with the floating connector 101 constructed in this manner, the mating contacts provided on the mating connector make contact with the mating sections 111 of the contacts 110, so that the circuit board on which the mating connector is mounted and the circuit board on which the floating connector 101 is mounted are electrically connected. In cases where there is positional deviation at the time of mating of these two connectors, and especially in cases where there is positional deviation in the vertical direction, the movable housing 120 moves in the vertical direction with respect to the fixed housing 130, so that the positional deviation can be accommodated easily. Furthermore, even if an obstacle or the like collides from directly above the movable housing 120, so that a strong impact is applied to the movable housing 120, this impact is absorbed and attenuated by the flexible links 113 of the contacts 110. Accordingly, the generation of cracks in the solder connected portions of the terminal sections 112 can be prevented. Moreover, since the pin bodies 140 pass through the fixed housing 130 and movable housing 120, the direction of movement of the movable housing 120 is restricted by the pin bodies 140.

However, the several problems have been encountered in this conventional floating connector 101. Specifically, the tips 141 of the pin bodies 140 are inserted so as to pass through the first through-holes 122 in the movable housing 120. Meanwhile, the tips 141 of the pin bodies 140 are formed so that the diameter thereof is merely slightly smaller than the diameter of the first through-holes 122. Accordingly, when the movable housing 120 moves in the vertical direction with respect to the fixed housing 130, there are cases in which the tips 141 of the pin bodies 140 contact the inner circumferential surfaces of the first through-holes 122. Here, in cases where the material of the movable housing 120 is a relatively hard material (e.g., liquid crystal polymer containing glass fiber), there are cases in which metal plating such as tin plating that is applied to the outer circumferential surfaces of the tips 141 is peeled off as a result of the contact with the inner circumferential surfaces of the first through-holes 122, leading to a deleterious effect on the surrounding areas. Since the rear ends 143 of the pin bodies 140 are connected by soldering to the circuit board, it is necessary to perform metal plating such as tin plating at least on the outer circumferential surfaces of the rear ends 143. However, if such partial plating is applied, the cost is increased, so that it is common to apply metal plating to the outer circumferential surfaces of the entire pin bodies 140 including the tips 141.

SUMMARY

Accordingly, the present invention was devised in light of the problems described above. It is an object of the invention to provide a floating connector which can avoid a danger of the pin bodies contacting the inner circumferential surfaces of the through-holes in the movable housing when the movable housing moves in the vertical direction with respect to the fixed housing.

The floating connector according to an embodiment of the invention includes contacts each having a mating section that contacts a mating contact, a terminal section that is connected to a circuit board and a flexible link that links the mating section with the terminal section. A movable housing houses the mating sections of the contacts. A fixed housing fastens the terminal sections of the contacts in place. Pin bodies are inserted through both first through-holes passing through the movable housing and second through-holes passing through the fixed housing, with the movable housing being disposed on top of the fixed housing at a specified distance from the fixed housing. The fixed housing has a housing main body that fastens the terminal sections in place and tubular bosses that protrude from this housing main body. Second through-holes are formed so as to pass through both the housing main body and the bosses, and the inner diameter of the first through-holes in the movable housing allows the bosses to be inserted and also allows the movable housing to move upward and downward with respect to the fixed housing, so that the bosses are inserted into these first through-holes.

BRIEF DESCRIPTION OF THE DRAWINGS

The invention will now be described by way of example to the accompanying figures of which.

DETAILED DESCRIPTION OF THE PREFERRED EMBODIMENT(S)

Figure 1:
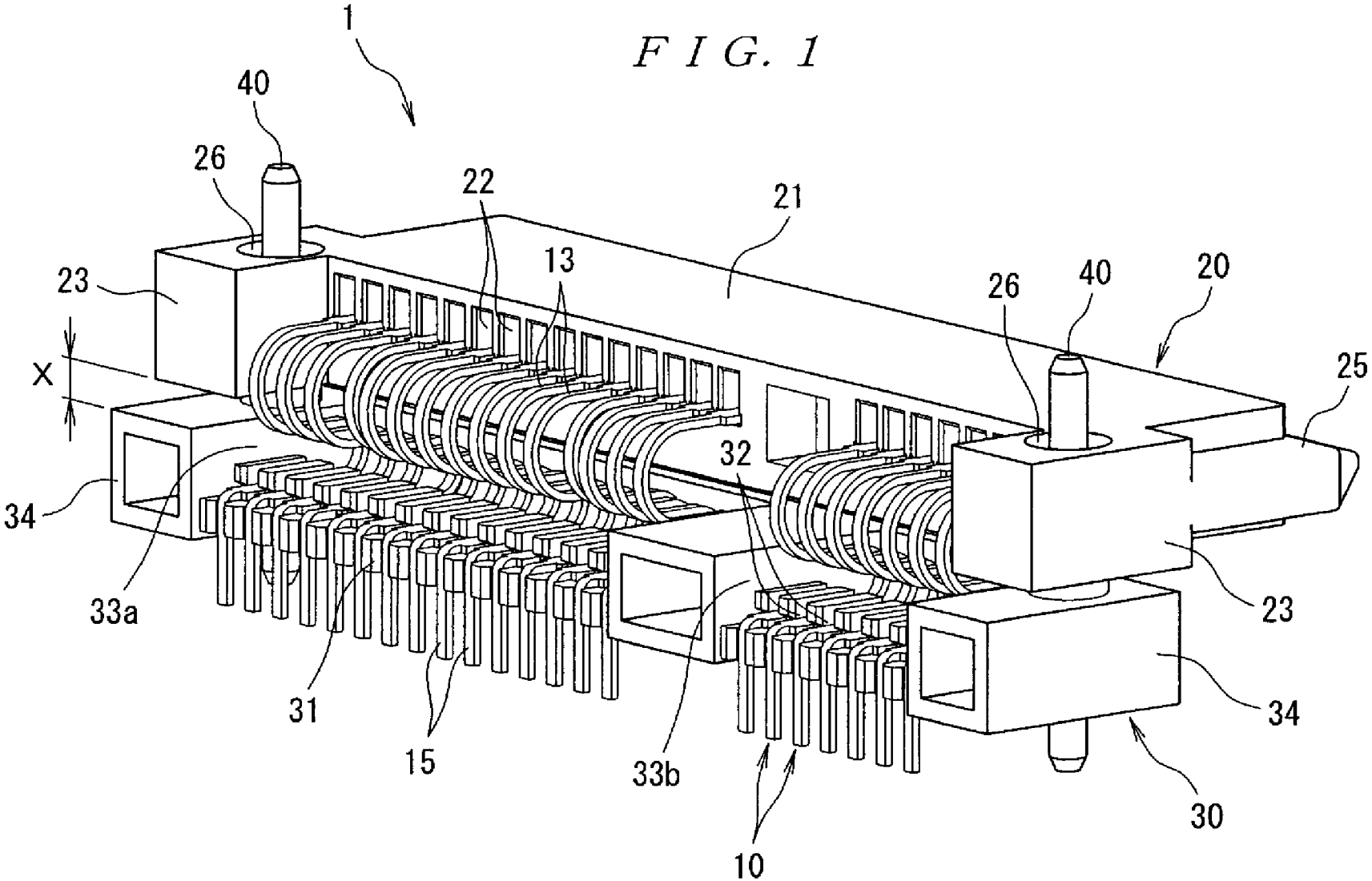
FIG. 1 is a perspective view of the floating connector according to an embodiment of the invention as seen from the back side.
Figure 2:
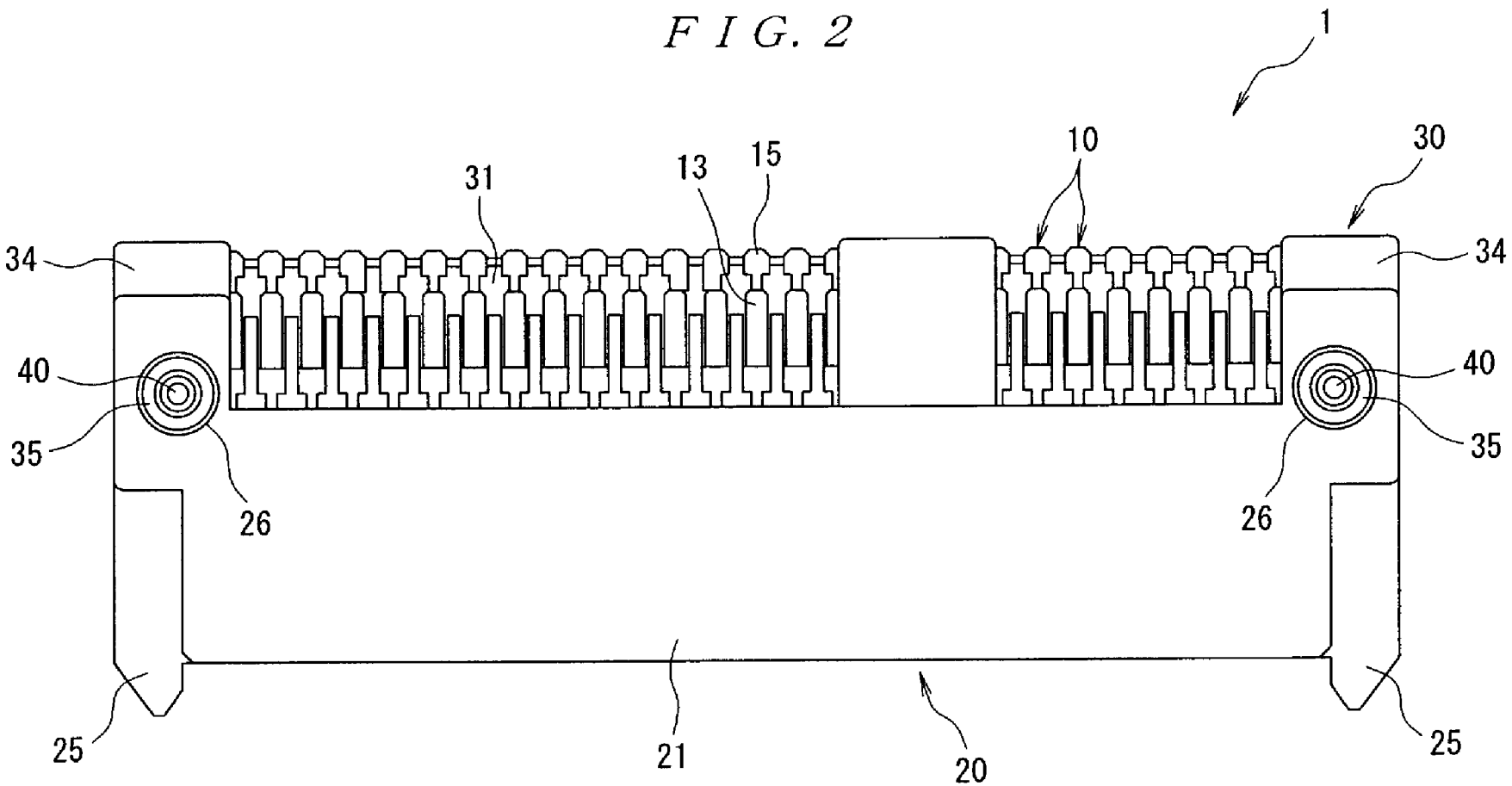
FIG. 2 is a plan view of the floating connector shown in FIG. 1.

Next, an embodiment of the invention will be described with reference to the figures. In FIG. 1, the floating connector 1 comprises a plurality of contacts 10 made of metal, an insulating movable housing 20, an insulating fixed housing 30, and a pair of pin bodies 40.

Figure 7:
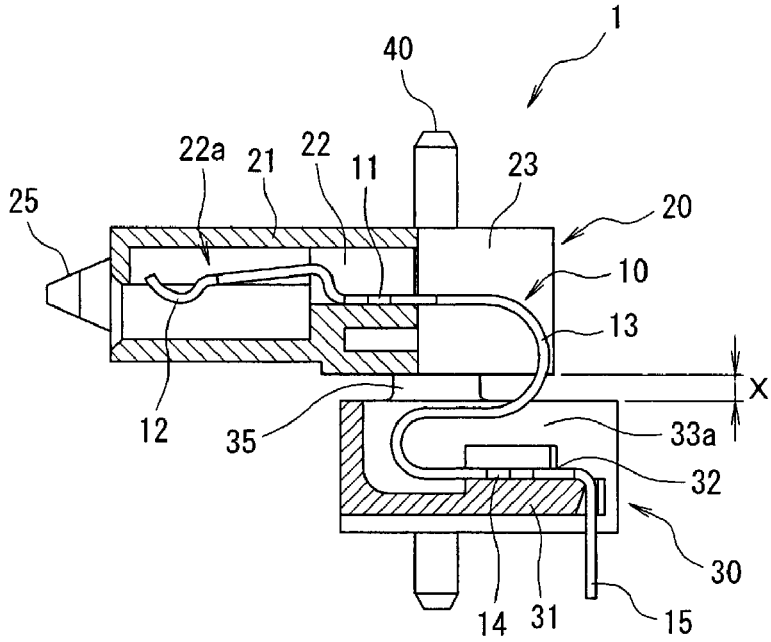
FIG. 7 is a sectional view taken along line 7—7 of FIG. 3.

Here, as is clearly shown in FIG. 7, each of the contacts 10 comprises a retention section 11 that is to be press-fitted into the movable housing 20, a mating section 12 that extends forward (leftward in FIG. 7) from the retention section 11 and that contacts one of the mating contacts (not shown in the figures) provided on a mating connector, a flexible link 13 that extends rearward from the retention section 11, a retention section 14 that is provided at the rear end of the flexible link 13 and that is to be press-fitted to the fixed housing 30, and a terminal section 15 that extends downward after first extending rearward from the retention section 14 and that is connected to a circuit board (not shown in the figures). The flexible link 13 of each contact 10 extends rearward from the retention section 11, is then bent back to extend forward, and is again bent back to extend rearward. The flexible link 13 is designed to link the mating section 12 and the terminal 15. Each contact 10 is formed by stamping and forming metal. The mating connector is mounted on another circuit board that is disposed perpendicularly to the circuit board to which the terminal sections 15 are connected.

Figure 3:
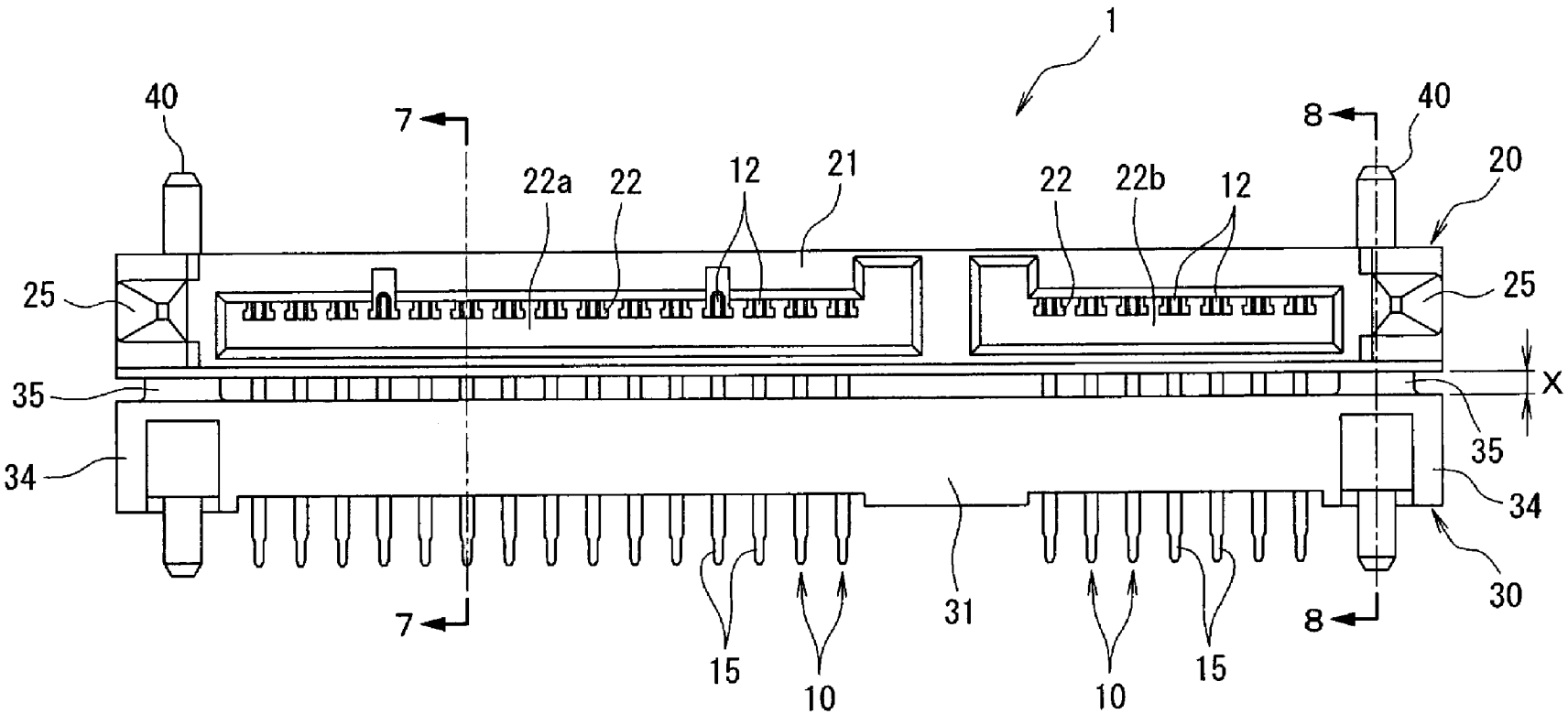
FIG. 3 is a front view of the floating connector shown in FIG. 1.
Figure 4:
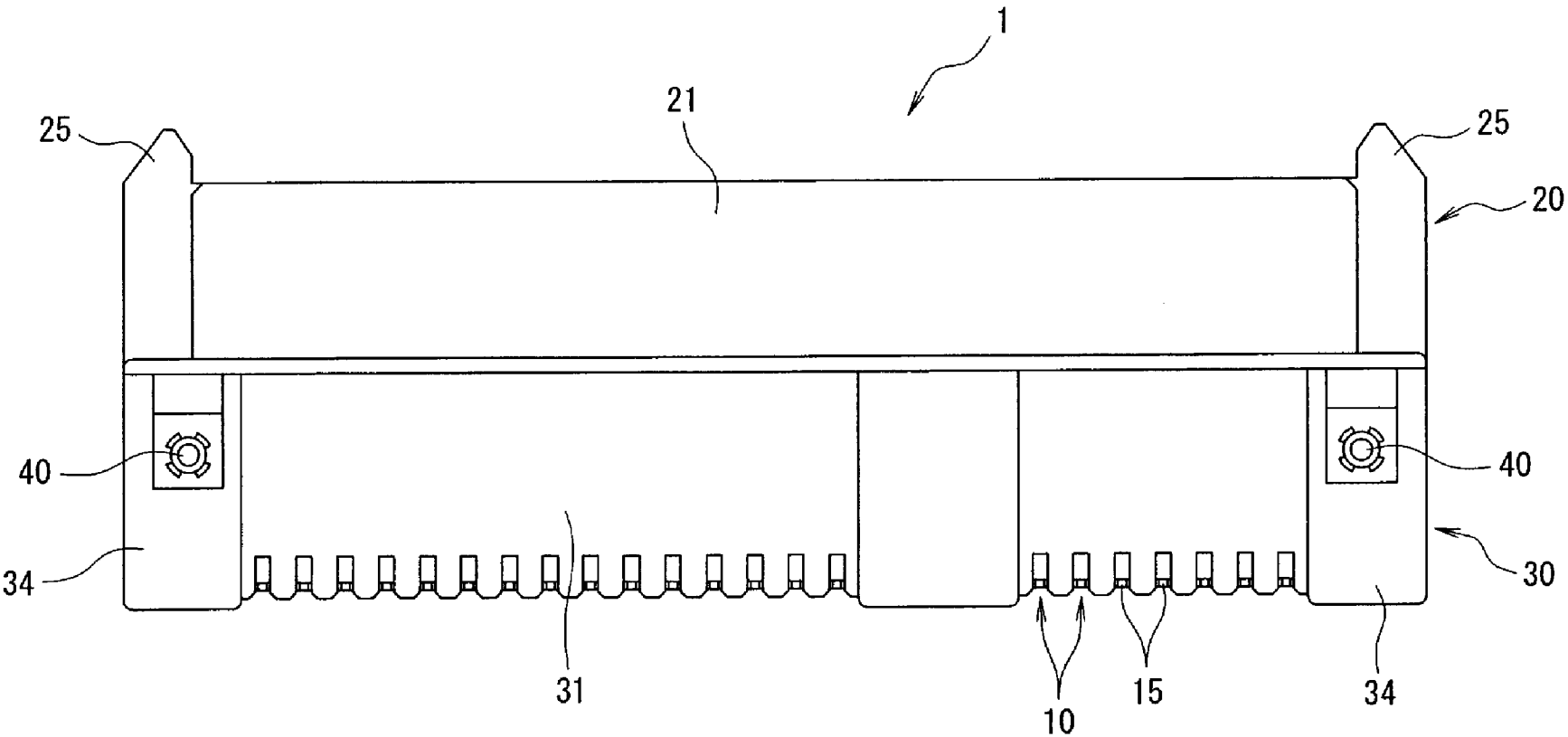
FIG. 4 is a bottom view of the floating connector shown in FIG. 1.
Figure 5:
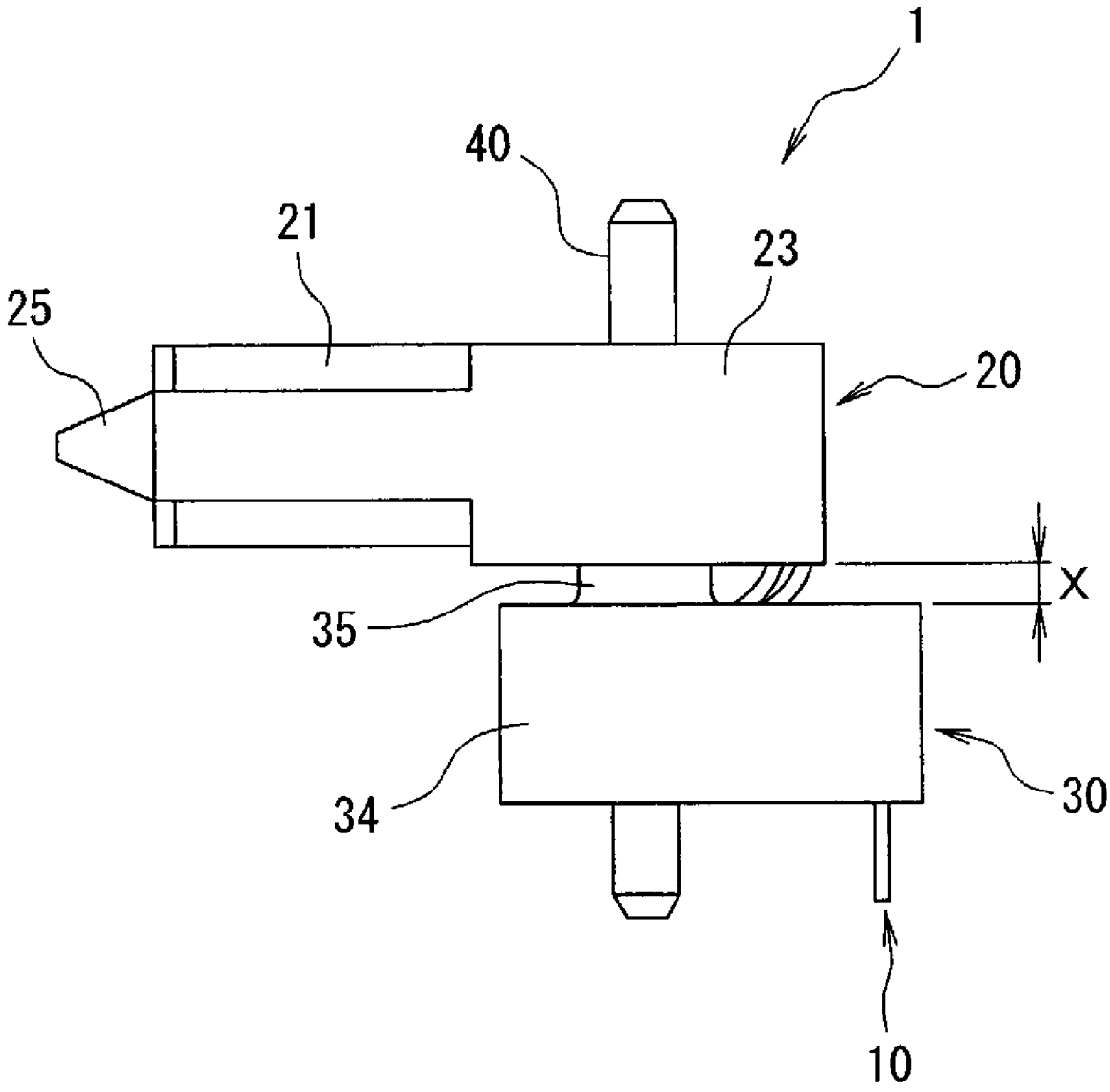
FIG. 5 is a right-side view of the floating connector shown in FIG. 1.
Figure 6:
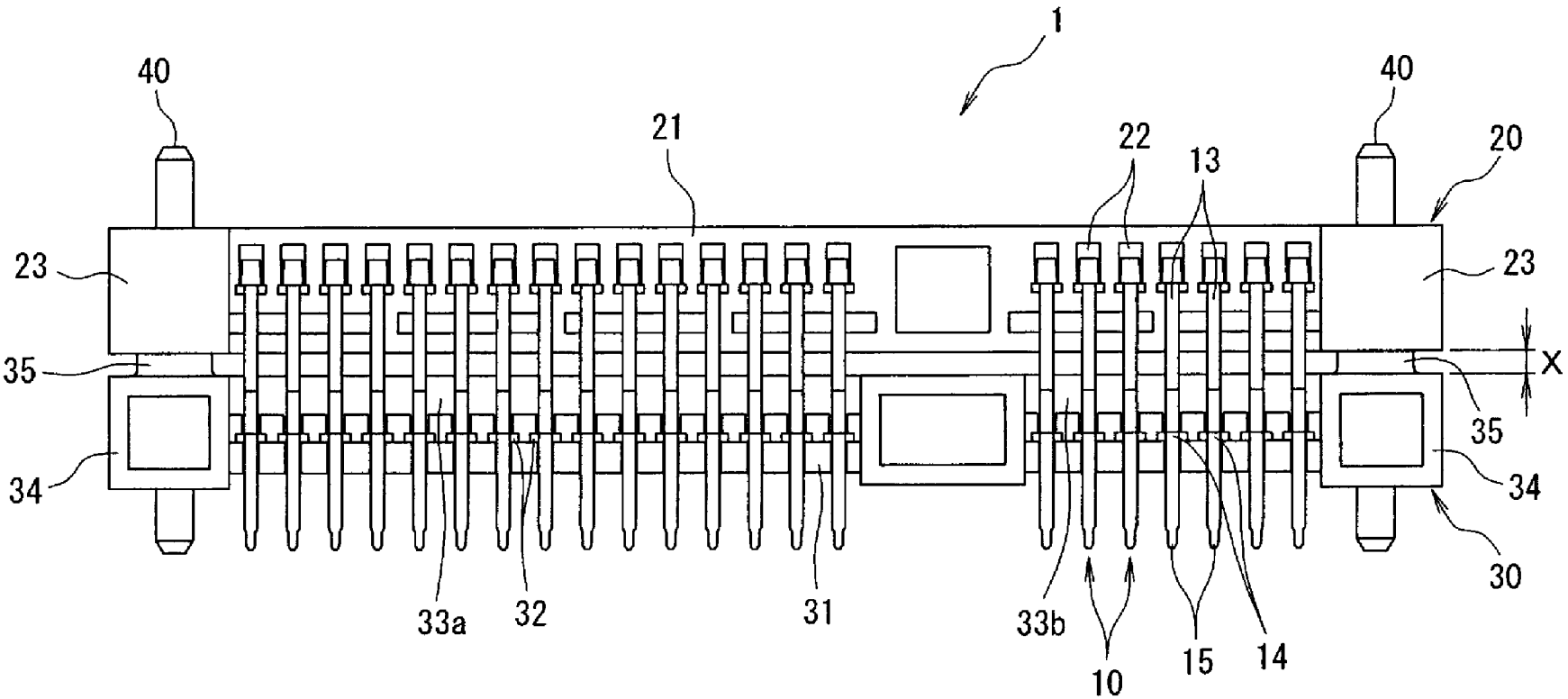
FIG. 6 is a back view of the floating connector shown in FIG. 1.

Furthermore, the movable housing 20 comprises a substantially rectangular movable housing main body 21 that extends in the direction of length (left-right direction in FIG. 3), and is formed by molding an insulative material. A plurality of contact passageways 22 that receive the retention sections 11 of the plurality of contacts 10 are formed in the movable housing main body 21 at a specified pitch along the direction of length. In addition, as is shown in FIG. 3, a plurality of mating connector receiving openings 22*a* and 22*b* (two connector receiving openings in the present embodiment) are provided in the movable housing main body 21. These connector receiving openings 22*a* and 22*b* are provided so that the mating connector receiving opening 22*a* is positioned in front of and in communication with a specified number of contact passageways 22 (15 contact passageways in the present embodiment), while the mating connector receiving opening 22*b* is positioned in front of and in communication with a specified number of contact passageways 22 (seven contact passageways in the present embodiment). Furthermore, a pair of pin body receiving parts 23 that protrude rearward from the movable housing main body 21 are provided at either end of the movable housing main body 21 as shown in FIG. 1. First through-holes 26 that pass through in the vertical direction are formed in the respective pin body receiving parts 23. A pair of guide posts 25 that are used during mating with the mating connector are provided at either end of the movable housing main body 21 in the front portion of the pin body receiving parts 23.

In addition, when the retention sections 11 of the respective contacts 10 are press-fitted to the respective contact passageways 22, the mating sections 12 of the respective contacts extend into the interior of the mating connector receiving opening 22*a* or 22*b*, and the flexible links 13 of the respective contacts 10 protrude rearward from the movable housing main body 21 so that these flexible links 13 are positioned between the pair of pin body receiving parts 23 as shown in FIG. 1.

Figure 8:
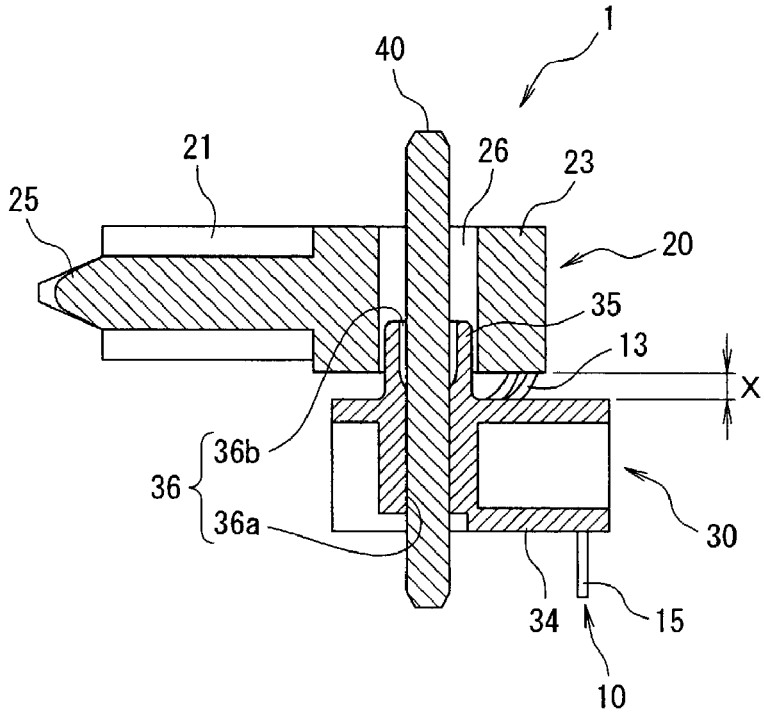
FIG. 8 is a sectional view taken along line 8—8 of FIG. 3.
Figure 9A:
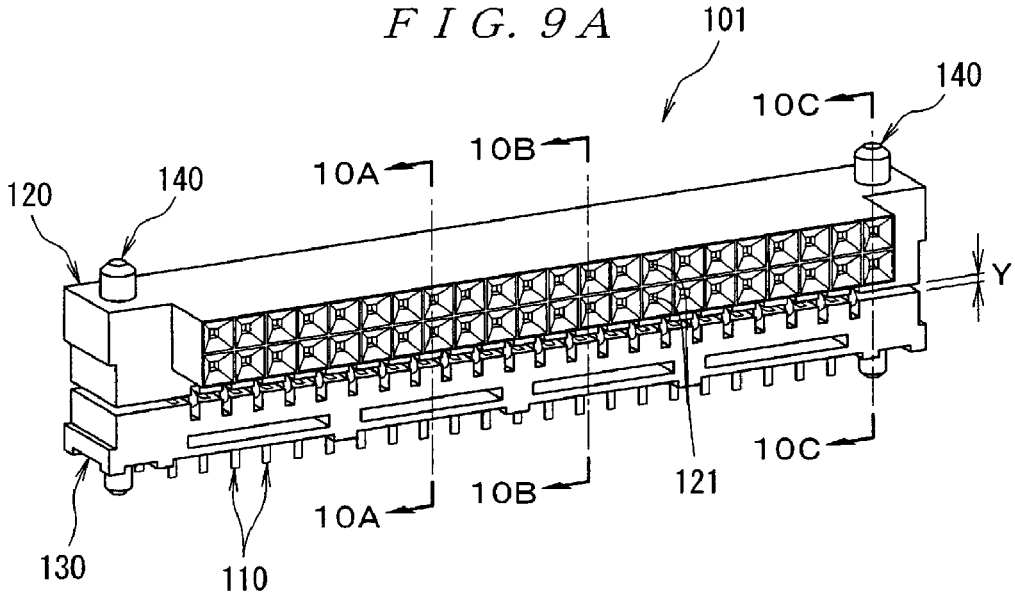
FIGS. 9A and 9B show a conventional floating connector, with FIG. 9A being a perspective view as seen from the front side, and FIG. 9B being a perspective view as seen from the back side.
Figure 9B:
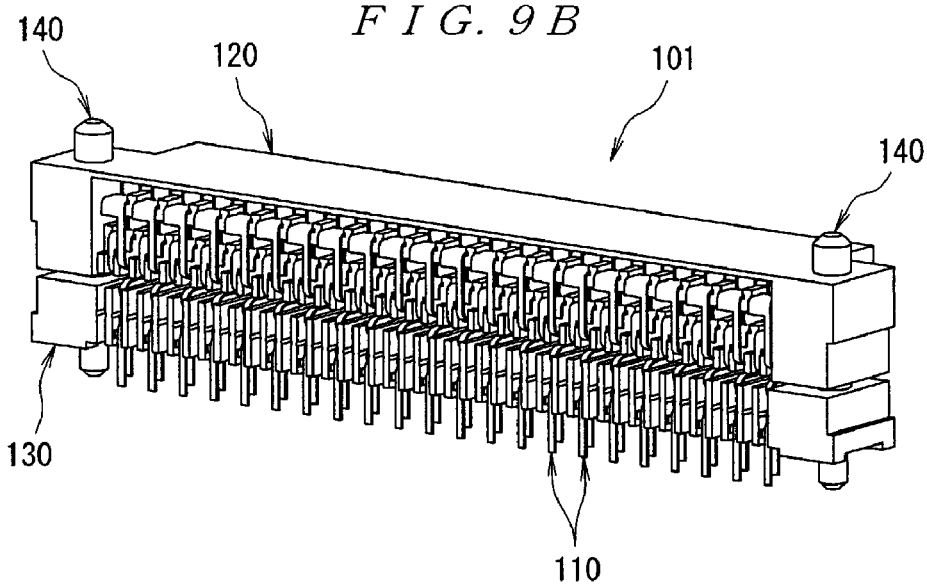
Prior Art FIG. 9B
Figure 10C:
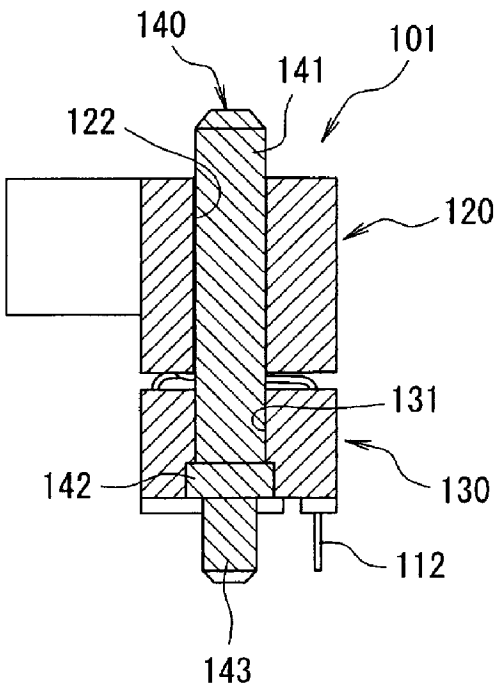
FIGS. 10A to 10C show the floating connector of FIGS. 9A and 9B, with FIG. 10A being a sectional view taken along line 10A—10A in FIG. 9A, FIG. 10B being a sectional view taken along line 10B—10B in FIG. 9A, and FIG. 10C being a sectional view taken along line 10C—10C in FIG. 9A.
Figure 10B:
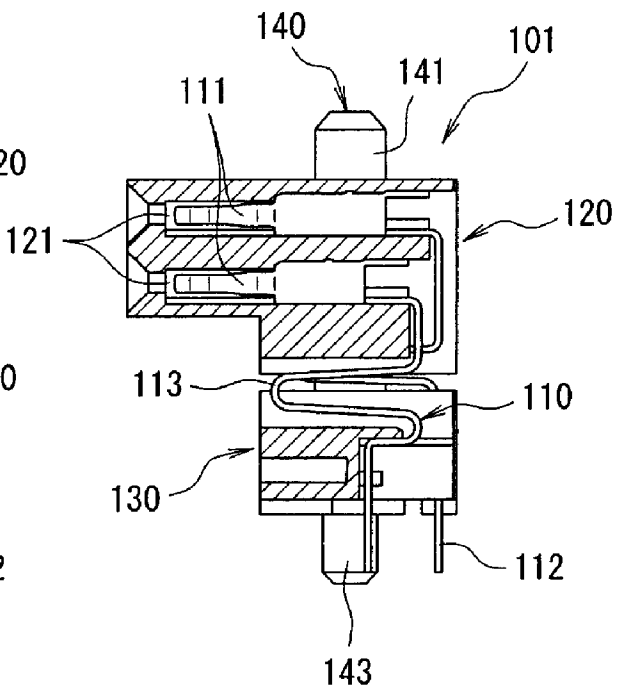
Prior Art FIG. 10B
Figure 10A:
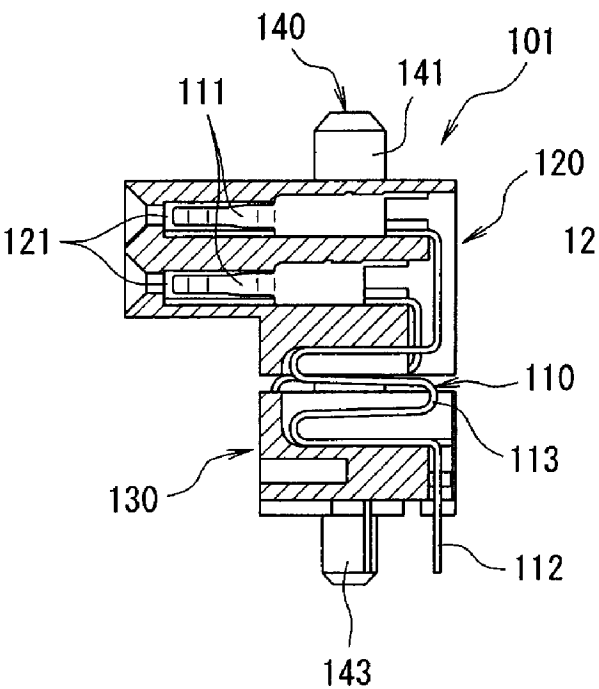
Prior Art FIG. 10A

The fixed housing 30 comprises a substantially rectangular fixed housing main body 31 that extends in the direction of length (left-right direction in FIG. 3), and is formed by molding an insulative material. A plurality of contact fastening grooves 32 that are used for the retention sections 14 of the plurality of contacts 10 to be press-fitted are formed in the fixed housing main body 31 at the same pitch as that of the contact passageways 22 along the direction of length. In addition, the fixed housing main body 31 is provided with a flexible link accommodating space 33*a* with which a specified number of contact fastening grooves 32 (15 contact fastening grooves in the present embodiment) communicate and a flexible link accommodating space 33*b* with which a specified number of contact fastening grooves 32 (seven contact fastening grooves in the present embodiment) communicate. A pair of pin body receiving parts 34 are provided at either end of the fixed housing main body 31 in the direction of length. Tubular bosses 35 that protrude upward from the respective pin body receiving parts 34 are provided on the respective pin body receiving parts 34 in positions corresponding to the first through-holes 26. Second through-holes 36 are bored so as to pass through both the respective pin body receiving parts 34 and bosses 35 in the vertical direction. The second through-holes 36 are constructed from pres-fit sections 36*a* that are used for the pin bodies 40 to be press-fitted and enlarged sections 36*b* that have a diameter slightly larger than the diameter of the pres-fit sections 36*a* and the outer diameter of the pin bodies 40. In addition, as is shown in FIG. 8, the inner diameter of the first through-holes 26 in the movable housing 20 is a size that allows the bosses 35 to be inserted and that also allows the movable housing 20 to move upward and downward with respect to the fixed housing 30. Thus, the bosses 35 are inserted into the first through-holes 26.

When the retention sections 14 of the respective contacts 10 are press-fitted to the respective contact fastening grooves 32, the flexible links 13 of the respective contacts are designed to be accommodated so as to extend into the interior of the flexible link accommodating space 33*a* or 33*b*, and the terminal sections 15 of the respective contacts 10 are designed to protrude downward from the fixed housing main body 31 so that these flexible links 13 are positioned between the pair of pin body receiving parts 34. As is shown in FIGS. 1, 7, and 8, the movable housing 20 is disposed on top of the fixed housing 30 at a distance x from the fixed housing 30 by press-fitting the retention sections 11 of the respective contacts 10 into the respective contact passageways 22 in the movable housing 20 and by press-fitting the retention sections 14 of the respective contacts 10 into the respective contact fastening grooves 32 in the fixed housing 30. In addition, a construction is used in which the movable housing 20 is linked to the fixed housing 30 via the flexible links 13 of the contacts 10.

Furthermore, each pin body 40 is constructed from a cylindrical metal rod, and plated with metal such as tin applied to the entire outer surface thereof. As is shown in FIG. 8, the respective pin bodies 40 are passed through the respective second through-holes 36 from the bottom of the fixed housing 30 and inserted through the first through-holes 26 in the movable housing 20. The diameter of each pin body 40 is selected to be press-fit into the pres-fit sections 36*a* of the second through-holes 36. The ends of the respective pin bodies 40 protrude from the upper surface of the movable housing 20 in a when the respective pin bodies 40 are inserted through the first through-holes 26 as shown in FIG. 8.

The lower end portions of the respective pin bodies 40 are inserted through positioning holes (not shown in the figures) formed in the circuit board, and are connected by soldering, and the terminal sections 15 of the respective contacts 10 are connected by soldering to through-holes (not shown in the figures) formed in the circuit board. As a result, the floating connector 1 is mounted on the circuit board. In this case, the respective pin bodies 40 function as positioning posts for positioning the floating connector 1 with respect to the circuit board. Meanwhile, the upper end portions of the respective pin bodies 40 mate with positioning holes (not shown in the figures) formed in the housing (not shown in the figures) of an electronic device on which the floating connector 1 is mounted; as a result, the floating connector 1 is positioned with respect to this housing as well.

When the mating connector mates with the floating connector 1 constructed in this manner, the mating contacts provided on the mating connector make contact with the mating sections 12 of the contacts 10, so that the circuit board on which the mating connector is mounted and the circuit board on which the floating connector 1 is mounted are electrically connected. In cases where there is positional deviation during the mating of these two connectors, and especially in cases where positional deviation is present in the vertical direction, the movable housing 20 moves in the vertical direction with respect to the fixed housing 30, so that the positional deviation can be absorbed easily. Furthermore, even if a strong impact is applied to the movable housing 20 as a result of an obstacle or the like colliding from directly above the movable housing 20, this impact is absorbed and attenuated by the flexible links 13 of the contacts 10. Accordingly, the cracks in the solder connected portions of the terminal sections 15 can be prevented. Moreover, since the tubular bosses 35 of the fixed housing 30 are inserted into the first through-holes 26 in the movable housing 20, the movement of the movable housing 20 in the circumferential direction perpendicular to the direction of protrusion of the bosses 35 is restricted by the insertion of the bosses 35 into the first through-holes 26.

The second through-holes 36 through which the pin bodies 40 are inserted are formed so as to pass through both the pin body receiving parts (housing main body) 34 and bosses 35, and the inner diameter of the first through-holes 26 is a size that allows the slideable insertion of the bosses 35 and that also allows the vertical movement of the movable housing 20 with respect to the fixed housing 30, so that the bosses 35 are inserted into the first through-holes 26. Accordingly, the inner diameter of the first through-holes 26 is sufficiently larger than the outer diameter of the pin bodies 40, so that there is no danger of the pin bodies 40 contacting the inner circumferential surfaces of the first through-holes 26 when the movable housing 20 moves in the vertical direction with respect to the fixed housing 30. As a result, even in cases where the material of the movable housing 20 is a relatively hard material (e.g., liquid crystal polymer containing glass fiber), there is no stripping of the metal plating applied to the outer circumferential surfaces of the pin bodies 40.

An embodiment of the present invention has been described above. However, the present invention is not limited to this embodiment, and various alterations and modifications can be made.

For example, the shape of the contacts 10 is not limited to the shape shown in the figures as long as each contact has a mating section for the contact with the corresponding mating contact, a terminal section for the connection to the circuit board, and a flexible link that links the mating section and terminal section and that has flexibility.

Furthermore, the shape of the movable housing 20 is not limited to the shape shown in the figures as long as this movable housing 20 is a housing which accommodates the mating sections of the contacts 10, which is laminated at a specified distance from the fixed housing 30, and in which the inner diameter of the first through-holes 24 through which the pin bodies 40 are inserted is set at a size that allows the bosses 35 to be inserted and that also allows the movable housing 20 to move upward and downward with respect to the fixed housing 30.

Moreover, the shape of the fixed housing 30 is not limited to the shape shown in the figures as long as this fixed housing 30 is a housing which fastens the terminal sections of the contacts 10 in place, and in which the second through-holes through which the pin bodies 40 are inserted respectively pass through both the pin body receiving parts (housing main body) 34 and bosses 35, with these bosses 35 being inserted into the first through-holes 24.

What is claimed is:

1. A floating connector comprising:

contacts each having a mating section that contacts a mating contact, a terminal section for connecting to a circuit board, and a flexible link that links the mating section with the terminal section;

a movable housing receiving the mating sections of the contacts and having first through-holes;

a fixed housing having a housing main body that fastens the terminal sections in place, tubular bosses that protrude from the housing main body and second through-holes that pass through both a pin body receiving part of the fixed housing main body and the tubular bosses;

pin bodies being inserted through the first through-holes and second through-holes, the movable housing being disposed on top of the fixed housing at a specified distance from the fixed housing, wherein the inner diameter of the first through-holes in the movable housing allows the bosses to be slideably inserted therein and also allows the movable housing to move upward and downward with respect to the fixed housing.

2. The floating connector of claim 1 wherein the second through-holes each comprise a press-fit section and an enlarged section having an inner diameter which is greater than that of the press-fit section.

3. The floating connector of claim 2 wherein each mating section comprises a retention section press fit into a respective passageway of the movable housing.

4. The floating connector of claim 3 wherein each terminal section comprises a retention section press fit into a contact fastening groove of the fixed housing.

5. The floating connector of claim 4 wherein the flexible links are received in flexible link accommodating spaces of the fixed housing.

6. The floating connector of claim 2 wherein the pin bodies are secured within the press-fit sections.

7. The floating connector of claim 6 wherein the pin bodies protrude from a bottom end of the fixed housing for insertion into positioning holes of a circuit board.

8. The floating connector of claim 7 wherein the pin bodies are plated.

9. The floating connector of claim 2 further comprising guide posts located at either end of the movable housing for engaging a mating connector.

* * * * *